US008196849B1

(12) United States Patent
Abramov et al.

(10) Patent No.: US 8,196,849 B1
(45) Date of Patent: Jun. 12, 2012

(54) ROLLER-TYPE HOMOGENIZING MILL

(75) Inventors: Yakov Kuzmich Abramov, Moscow (RU); Vladimir Mihailovich Veselov, Moscow (RU); Viktor Mihailovich Zalevsky, Moscow (RU); Nikolay Aleksandrovich Gukasov, Moscow (RU); Fedor Maksimovich Sevastjanov, Moscow (RU); Mansur Faridovich Ibragimov, Tambov (RU); Aleksandr Fedorovich Rassolov, Moscow (RU)

(73) Assignee: Twin Trading Company (RU)

( * ) Notice: Subject to any disclaimer, the term of this patent is extended or adjusted under 35 U.S.C. 154(b) by 0 days.

(21) Appl. No.: 13/389,646

(22) PCT Filed: Jun. 11, 2010

(86) PCT No.: PCT/RU2010/000309

§ 371 (c)(1), (2), (4) Date: Feb. 9, 2012

(87) PCT Pub. No.: WO2011/021960

PCT Pub. Date: Feb. 24, 2011

(30) Foreign Application Priority Data

Aug. 18, 2009 (RU) ..... 2009131176

(51) Int. Cl.
*B02C 4/02* (2006.01)

(52) U.S. Cl. ..... 241/65; 241/101.8; 241/111; 241/117

(58) Field of Classification Search ..... 241/111, 241/112, 101.8, 65, 66, 67
See application file for complete search history.

(56) References Cited

U.S. PATENT DOCUMENTS

| | | | | |
|---|---|---|---|---|
| 1,891,165 | A * | 12/1932 | Knupffer | 241/111 |
| 3,045,933 | A * | 7/1962 | Di Mino | 241/111 |
| 2002/0178608 | A1 | 12/2002 | Leonovs | |

FOREIGN PATENT DOCUMENTS

| | | |
|---|---|---|
| RU | 2132233 | 6/1999 |
| SU | 287511 | 11/1970 |
| SU | 354886 | 10/1972 |
| WO | WO92/13639 | 8/1992 |

OTHER PUBLICATIONS

OJSC "TYAZHMASH" http://www.tyazhmash.com MVS roller mills with separators for grinding machines of pulverized coal (PUT) injection systems in blast furnaces http://www.tyazhmash.com/lib/mys.shtml_Volkov_A.B. OJSC "TYAZHMASH" (paragraph 4).

* cited by examiner

*Primary Examiner* — Mark Rosenbaum
(74) *Attorney, Agent, or Firm* — Yefim Kreydin

(57) ABSTRACT

The invention relates to the grinding method with simultaneous homogenization of powder-like materials with liquid components in construction engineering, chemical and other industries.

The roller breaker-homogenizer comprises a cone-shaped backing roll and not less than three driven rolls and driven rolls, the large bases of which face reverse directions. The rolls are arranged in the case with a replaceable cup vertically at the same level so that the driven rolls are located epicyclically relative to the backing roll and mounted in cantilever fashion in the case cover rotation bearing assemblies, and the backing roll is connected axially with a drive shaft via a spring coupling. An appliance used to regulate the spring coupling pressing force is mounted between the drive and spring coupling. The case cover has an opening for loading basic process materials above the upper end surface of the backing roll, and an anchor-type mixer is fixed on the lower end surface of the backing roll.

3 Claims, 1 Drawing Sheet

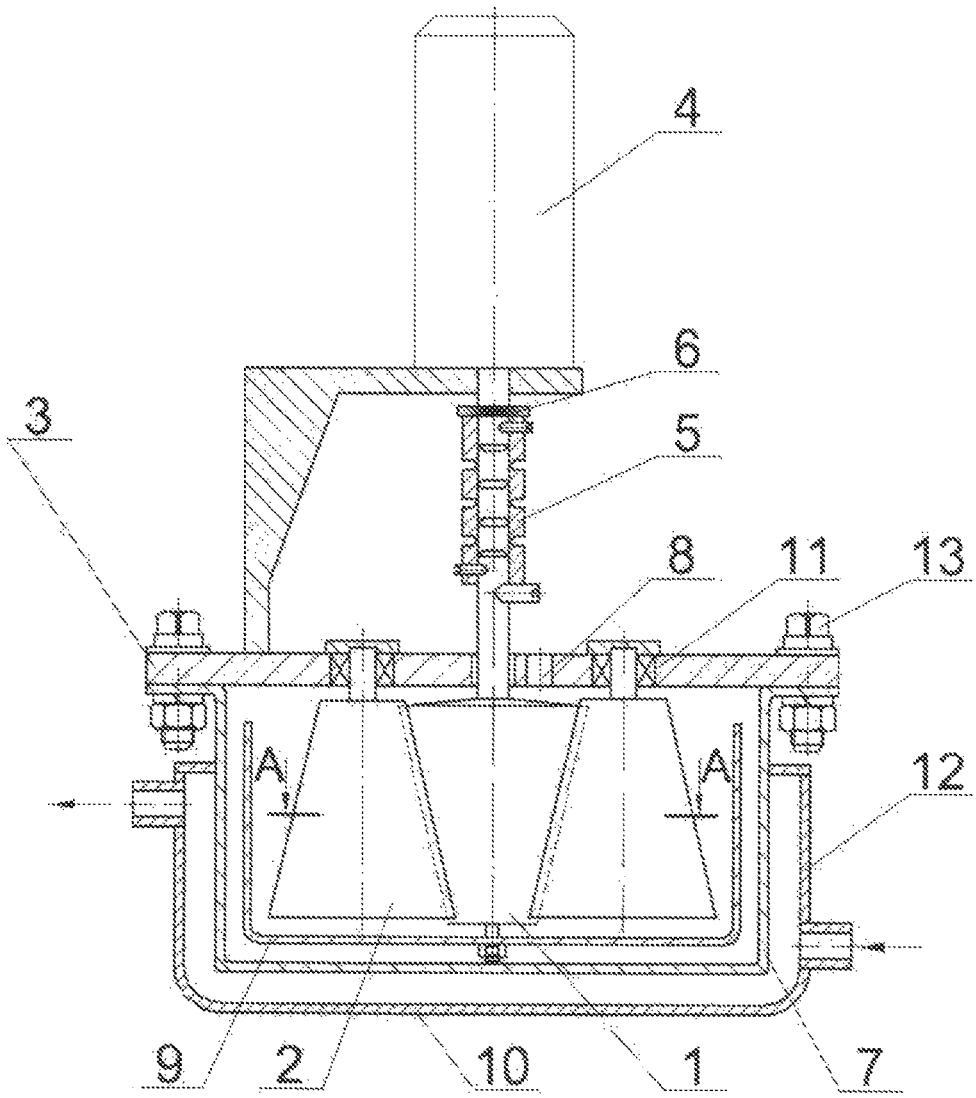
A - A
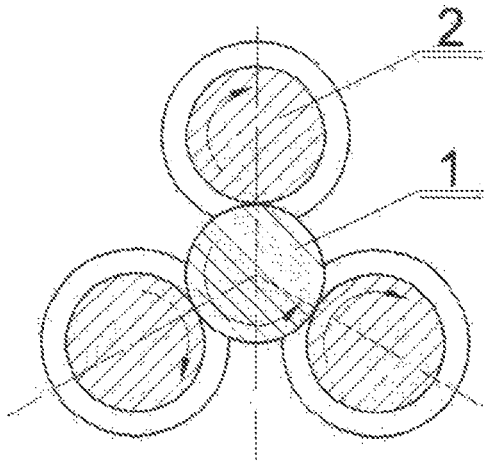

ROLLER-TYPE HOMOGENIZING MILL

This application is the United States national phase application of International Application PCT/RU2010/000309 filed Jun. 11, 2010, which claims the benefit of Russian Patent application No RU 2009131176 FILED Aug. 18, 2009, the entire disclosure of which is incorporated herein by reference.

BACKGROUND OF THE INVENTION

The present invention relates to the grinding method with simultaneous homogenization of powder materials with liquid components and can be used in industries producing composites based on disperse powder materials, such as talc, kaolin, gypsum bound by thermoplastic or other liquid plastic binders as well as in chemical and other industries.

The peculiar characteristics of roller breakers also capable to homogenize composite materials are their relatively small sizes, low noise level, optimal distribution of mechanical power for material processing at effective power consumption compared to drum, bead and hammer mills. Roller breakers are quite flexible to be readjusted to obtain the required degrees of grinding and homogenization.

The most effective ways for grinding fine dispersed materials are attrition grinding and crushing.

There are known cone-shaped rolling mills used for pulverized coal fuels manufactured by OJSC "Tyazhmash". These mills work by breaking original solid particles using cone-shaped rolls interacting with flat or sloped parts. The material passes through the bites and breaks as a result of being crushed.

These machines ensure effective grinding but due to their design they do not allow to provide homogenization of the mill material with a liquid component, e.g., using hot melts of such thermoplastic polymers as polyethylene, polypropylene etc. This ay be due to the design features of these mills or different rotation velocities of rotating crashing rolls and barrels and flat or sloped counterparts of the mechanisms that ensure only breaking of the material and do not allow the material being homogenized to circulate between crushing rolls during processing of the material.

There is a known roller breaker (Patent RU N 2132233, MPK B02C 4/24 published on 27 Jun. 1999) which includes cone-shaped backing and driven rolls mounted on the frame with their large bases facing opposite directions, and a driving mechanism. The shaft of the driven roll has two pulleys with cam gears installed in bearings on its ends. The latter have a drive which is connected with the two pulleys via a belt drive, and the driven roller itself is spring-loaded.

In this case the weight of cam gears and total weight of pulleys with driven shaft cam gears and bearings are defined by the dependencies making a connection between the weight of cam gears, pulley rotation velocity, eccentricity, spring tension, spring prestrain and total weight of pulleys with driven shaft cam gears and bearings.

According to this patent the device can be operated only in pre-resonant mode restricted by the above stated dependencies, and in this case the breaking effect is achieved due to impact-vibration action on the material in the bite between backing and driven rolls resulting in the restricted capacity control due to the fact that both rolls are working in the pre-resonant mode.

One of the disadvantages is that grinding in this device is performed when the rolls are being rotated with maximum effect at the moment corresponding to such a position of cam gears when their oscillation impact vector coincides with the direction of interaxial horizontal of the rolls and is directed to the backing roll, i.e. only once during a complete rotation of the rolls leading to the reduction of grinding capacity.

In case a bite between the rolls is maximally opened, at the moment when the oscillation impact vector of the cam gears is directed horizontally opposite to the backing roll, the mill material undergoes minimal force action.

All the above factors result in that the mill material will have a variable degree of dispersion when passing through a bite between the rolls during each rotation cycle of the latter with the most effective impact on the material achieved within not more that a quarter of the time required for one rotation of the driven roll. Besides, the two pulleys with a flexible drive are not capable of ensuring stable rotation velocity of the driven roller due to unavoidable frictional sliding of such drives in oscillation rotation mode of the pulleys having cam gears.

The closest to the present invention is a roller mill (USSR Inventor's Certificate N 354886, MPK B02C 4/30 published on 16 Oct. 1972 and dependent on Inventor's Certificate N 287511, MPK B02C4/04 published on 15 Nov. 1970).

According to Inventor's Certificate N 354886 the two rolls of this mill are cone-shaped, and a profiled surface of both rotating rolls is made in the form of longitudinal grooves and, besides, one of the rolls has grooves with V-shaped extending profile and the other has deep egg-shaped grooves. According to this invention the roller mill is designed to be used for grinding and homogenization of different organic pigments and semiproducts containing crystalline materials. The disadvantage of this device is that it can be operated only provided a mixture of basic liquid and powder components is made pasty before the process starts. This implies the use of some additional device, e.g., a mixer. Another disadvantage of this invention is that the longitudinal grooves, and the deep egg-shaped grooves in particular, act as stagnation areas where the paste being processed and its powder component in the first place is almost not subject to grinding, therefore reducing the grinding quality of the powder component and the production efficiency of the mill. The main purpose of this mill is dispersing and, to be more exact—homogenization of the prepared paste, and, in spite of the claimed cone shape of the rolls with the reverse arrangement of their similar end surfaces, the grinding effect for the powder component of the material being processed typical for cone-shaped roller mills is practically not achieved.

It should also be stated that different profiled surfaces of the grooves on the rolls make the process of their manufacturing quite complicated.

SUMMARY OF THE INVENTION

The basic engineering problem of the claimed invention is to increase grinding efficiency together with simultaneous homogenization of heterogenic compositions consisting of dispersed powder-like materials and liquid components, including thermoplastic polymers or heat convertible resins by feeding basic components to the rolls without preliminary preparation of the paste and by increasing quantity of the bites between the rolls.

The above task is accomplished by that in the roller breaker-homogenizer comprising cone-shaped backing and driven rolls, the large bases of which face opposite directions, and a driving mechanism, the rolls are arranged in the case with a replaceable cup vertically at the same level so that the driven rolls, not less than three of them, are located epicyclically relative to the backing roll and mounted in cantilever fashion in the case cover rotation bearing assemblies, and the backing roll is connected axially with the drive shaft via spring coupling, wherein the case cover has an opening for loading basic process materials above the upper end surface of the backing roll, and an anchor-type mixer is fixed on the lower end surface of the backing roll. The appliance used to regulate the coupling pressing force and, hence, the contact force of interaction between backing and driven rolls, is mounted between the drive and spring coupling.

The upper end surface of the backing roll, in its turn, can be made with cone slope directed to the driven rolls.

In case grinding is performed with simultaneous homogenization in order to produce composite materials containing dispersed powders and thermoplastic or thermoset polymers, the breaker-homogenizer has a heating and thermostatic control system.

Due to epicyclical arrangement of the driven rolls in which the basic material is subject to grinding and homogenization, and, in particular, when smooth rolls without surface grooves are used, the material undergoes constant and the most efficient action. Vertical arrangement of the rolls allows to provide multiple action on the material, while their horizontal arrangement provides almost single action resulting in the reduction of grinding and homogenization quality. The epicyclical arrangement of the vertical driven rolls makes possible additional mixing of the process material in the operating area that increases both dispersive uniformity of the process material and distribution efficiency of the powder in liquid material.

Compared to the prototype, the above inventive features allow to obtain the required grinding efficiency and at the same time homogenize powder materials with liquids and also with thermoplastic or thermoset polymers in order to produce composite materials with specific properties.

DETAILED DESCRIPTION OF THE EXEMPLARY EMBODIMENTS

The roller breaker-homogenizer is shown schematically in FIGURE.

It comprises a backing roll 1 and at least three driven rolls 2. The driven rolls 2 are mounted in cantilever fashion relative to the backing roll 1 and rotate in bearing assemblies 11 of a case cover 3, on which a drive support 4 is rigidly fixed. The backing roll shaft 1 is axially spring-loaded using a spring coupling 5 relative to a drive shaft 4. Axial pressing force of the spring coupling 5 is provided with an appliance 6 used to regulate the pressing force. The axial force of the backing roll 1 ensures the required friction interaction between it and the driven rolls 2. This axial force changes rotation velocities of the driven rolls 2 and, hence, grinding and homogenization modes of powder-like material interacting in at least three bites between the rolls. In order to prevent stagnation areas from forming around the rolls the backing roll 1 has an anchor-type mixer 9. The whole operating area of the device around the rolls is located inside a case cup 7, fixed with the case cover 3 using flanged contact joints 13.

An opening 8 for feeding basic material is located in the case cover 3 above the upper end surface of the backing roll 1, and this upper end surface of backing roll 1 has a cone-shaped slope relative to the driven rolls 2.

Operating volume of the case is restricted by the replaceable cup 7 which is additionally equipped with a heating and thermostatic control system 10 (jacket 12 for heat-transfer liquid) in case thermoplastic composite materials should be homogenized.

The breaker-homogenizer operates as follows.

The drive motor 4 via the spring coupling 5 rotates the backing roll 1, which interacts with the driven rolls 2 located epicyclically relative to the latter and rotates the driven rolls 2 via friction transmission together with powder-like mill material in the bites between the backing and driven rolls.

According to the known operating principle of cone-shaped rolls due to their shape a rolling motion occurs only in the cross section with equal diameters of contacting rolls, and in contacting zones of rolls with different diameters rotation velocities of contacting rolls vary. Theses zones are the zones where grinding and homogenization take place both in the axial and radial directions.

The axial force created by the spring couple 5 and controlled by the regulator 6 ensures required mechanical action on the material in the bites between the rolls.

The symmetric arrangement of the rolls ensures self-centering and stable sizes of working V-shaped bites between the rolls. There should be not less than three driven rolls.

Such arrangement of the rolls ensured simultaneous grinding and homogenization of the material in the three or more V-shaped bits. Depending on the sizes of the rolls and of the device in general, the quantity of the driven rolls and, hence, of the working bites can be increased to make the operating efficiency of the device higher.

The anchor-type mixer 9 ensures stable operation of the device. It regularly feeds the mill and homogenized materials from perimeter zones of the cup 7 to the working bites of the rolls.

In order to homogenize materials with thermoplastic polymers the case cup 7 has the heating jacket 12.

According to the present invention there is provided grinding of powder-like materials with their simultaneous homogenization with liquids, e.g., resins, paints, thermoplastic and thermoset polymers, such as polyethylene and polypropylene, in order to produce composite materials highly filled with talc, kaolin etc.

The invention claimed is:

1. A roller breaker-homogenizer comprising cone-shaped backing and driven rolls, large bases of which face reverse directions, and a driving mechanism, wherein the rolls are arranged in a case with a replaceable cup vertically at a same level so that the driven rolls, not less than three of them, are located epicyclically relative to the backing roll and mounted in cantilever fashion in case cover rotation bearing assemblies, and the backing roll is connected axially with a drive shaft via a spring coupling, wherein an appliance used to regulate the spring coupling pressing force is mounted between the drive and spring coupling, and the case cover has an opening for loading basic process materials above an upper end surface of the backing roll, and an anchor-type mixer is fixed on a lower end surface of the backing roll.

2. The roller breaker-homogenizer according to claim 1, wherein its case has a heating and thermostatic control system in order to ensure homogenization of hot melts of thermoplastic polymers with powder-like disperse compound products.

3. The roller breaker-homogenizer according to claim 1, wherein the upper end surface of the backing roll has a cone-shaped slope relative to the driven rolls.

* * * * *